US010023983B2

(12) United States Patent
Okada

(10) Patent No.: US 10,023,983 B2
(45) Date of Patent: Jul. 17, 2018

(54) SEWING MACHINE PRESSER FOOT

(71) Applicant: JANOME SEWING MACHINE Co., Ltd., Hachioji-shi, Tokyo (JP)

(72) Inventor: Mizuki Okada, Hachioji (JP)

(73) Assignee: JANOME SEWING MACHINE CO., LTD., Hachioji-Shi, Tokyo (JP)

( * ) Notice: Subject to any disclaimer, the term of this patent is extended or adjusted under 35 U.S.C. 154(b) by 30 days.

(21) Appl. No.: 15/224,525

(22) Filed: Jul. 30, 2016

(65) Prior Publication Data

US 2017/0073866 A1 Mar. 16, 2017

(30) Foreign Application Priority Data

Sep. 15, 2015 (JP) ..... 2015-181527

(51) Int. Cl.
*D05B 29/02* (2006.01)
*D05B 29/06* (2006.01)

(52) U.S. Cl.
CPC ..... *D05B 29/02* (2013.01); *D05B 29/06* (2013.01)

(58) Field of Classification Search
CPC ..... D05B 29/00–29/12; D05B 35/06; D05C 7/00–7/08
See application file for complete search history.

(56) References Cited

U.S. PATENT DOCUMENTS 1,432,974 A * 10/1922 De Voe ..... D05C 7/08 112/139
1,515,807 A * 11/1924 Corbin ..... D05B 35/06 112/139
1,616,637 A * 2/1927 Rankin ..... D05C 7/08 112/139
1,622,171 A * 3/1927 Anthony ..... D05C 7/08 112/139
1,685,194 A * 9/1928 Forseth ..... D05C 7/08 112/139
1,704,095 A * 3/1929 Matthews ..... D05C 7/08 112/139
2,137,454 A * 11/1938 Litsey ..... D05C 7/08 112/101
2,737,914 A * 3/1956 Hofgesang ..... D05B 35/06 112/139

FOREIGN PATENT DOCUMENTS

JP 05-060477 U 8/1993
JP 2007-130056 A 5/2007

* cited by examiner

*Primary Examiner* — Ismael Izaguirre
(74) *Attorney, Agent, or Firm* — McGinn IP Law Group, PLLC

(57) ABSTRACT

A sewing machine presser foot includes: a presser foot body including an attachment portion attached to a presser bar of a sewing machine, a supporting portion extending downward from the attachment portion , and a pressing portion in which, at a lower end of the supporting portion, a needle guiding hole having a string guiding groove for guiding a string is formed; and a cover member including a groove covering portion that crosses and covers the string guiding groove of the pressing portion, a supporting plate portion formed along the supporting portion continuously from the groove covering portion, and an attachment portion formed at an end of the supporting plate portion so as to be attached to the presser foot body. A right-side portion of the supporting plate portion of the cover member is fixed to the presser foot body A by the attachment portion.

16 Claims, 7 Drawing Sheets

Fig.2A
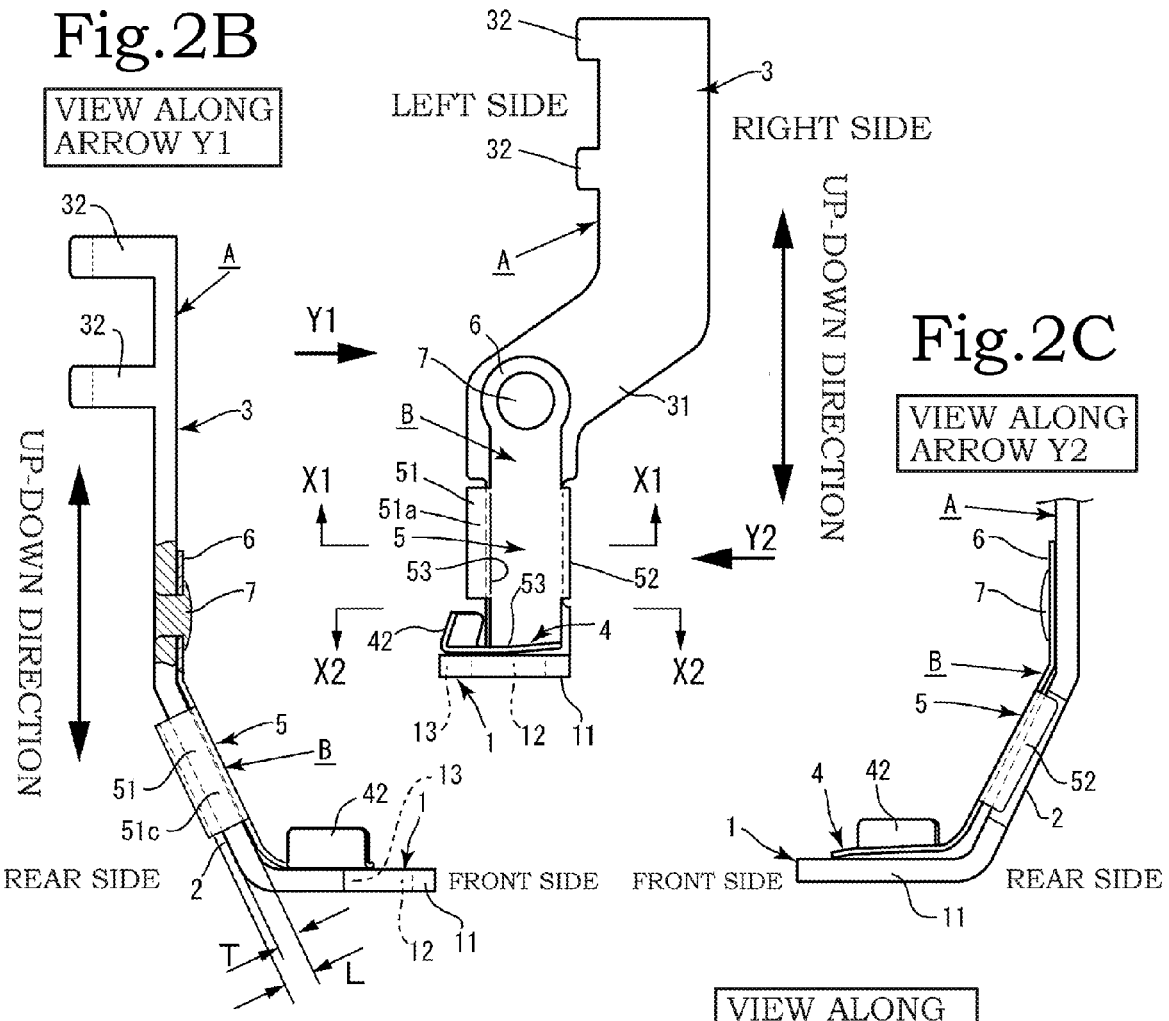
Fig.2B
VIEW ALONG ARROW Y1
Fig.2C
VIEW ALONG ARROW Y2
VIEW ALONG ARROW X1-X1
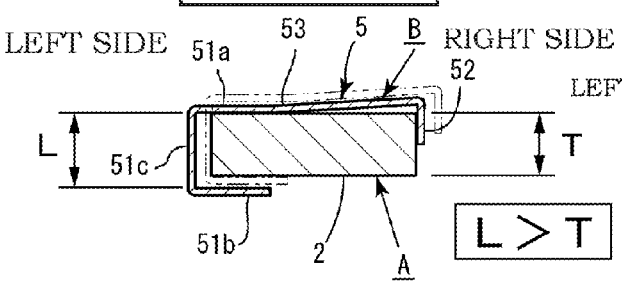
Fig.2D
VIEW ALONG ARROW X2-X2
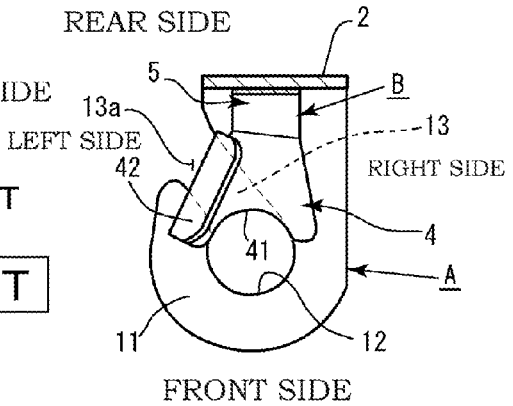
Fig.2E

VIEW ALONG ARROW X4-X4

VIEW ALONG ARROW Y4

VIEW ALONG ARROW X5-X5

VIEW ALONG ARROW Y5

SEWING MACHINE PRESSER FOOT

BACKGROUND OF THE INVENTION

1. Field of the Invention

The present invention relates to a sewing machine presser foot which is attached to a presser bar of the sewing machine and used to sew a decorative string of wool yarn or the like on a cloth, and which makes it easier to pass the decorative string through a needle guiding hole while reducing the probability of the decorative string detaching from the needle guiding hole.

2. Description of the Related Art

Some conventional home sewing machines are designed for what is called "couch stitching", which is a type of stitching means for sewing decorative wool yarn, embroidery threads, ribbons, etc. on a cloth. A couch stitching operation involves setting an upper thread, a lower thread, and an embroidery frame, passing a third decorative string through a presser foot attached to a sewing machine, and then performing stitching. In this couch stitching operation, a presser foot dedicated for the couch stitching is used.

SUMMARY OF THE INVENTION

As disclosed in Japanese Patent Application Publication No. 2007-130056, a presser foot dedicated for couch stitching typically includes a pressing portion in which a circular needle guiding hole is formed at the center of a disk and an attachment portion that is connected to a presser bar attached to a sewing machine body. In this type of presser foot, a decorative string needs to be inserted through the needle guiding hole, and especially when wool yarn or the like is used as the decorative string, inserting the string through the needle guiding hole of the presser foot becomes extremely difficult, because of the fluffiness of the string.

In Japanese Utility Model Application Publication No.H5-60477, a passage that provides communication between the inside and outside of a needle guiding hole of a pressing plate is provided so that a decorative string can be inserted from a horizontal direction in relation to the presser foot, thereby facilitating insertion of the decorative string into the needle guiding hole. This type of presser foot can make it easier for the decorative string to be inserted into the needle guiding hole of the presser foot, but unfavorably, the decorative string also detaches more easily from the needle guiding hole.

Under these circumstances, an object of the present invention is to provide a sewing machine presser foot dedicated for couch stitching, with which it is easier to insert the decorative string into a needle guiding hole of the presser foot in the setup process of couch stitching, while it is also possible to reduce the probability of the already-inserted string detaching from the needle guiding hole.

As a result of intensive studies to solve the above problems, the present inventor solved the problems by providing, as a first embodiment of the present invention, a sewing machine presser foot including: a presser foot body including an attachment portion attached to a presser bar of a sewing machine, a supporting portion extending downward from the attachment portion, and a pressing portion in which, at a lower end of the supporting portion, a needle guiding hole having a string guiding groove for guiding a string is formed; and a cover member including a groove covering portion that crosses and covers the string guiding groove of the pressing portion, a supporting plate portion formed along the supporting portion continuously from the groove covering portion, and an attachment portion formed at an end of the supporting plate portion so as to be attached to the presser foot body, wherein a right-side portion of the supporting plate portion of the cover member fixed to the presser foot body by the attachment portion is configured to be displaced from the supporting portion.

A second embodiment of the present invention solves the problems by the bobbin holder according to the first embodiment, in which a bent portion provided in the supporting plate portion is formed to be bent in such a direction that the supporting plate portion is displaced from the supporting portion in a left-right direction of the supporting plate portion of the cover member. A third embodiment of the present invention solves the problems by the bobbin holder according to the first or second embodiment, in which a string guide is formed to be erected continuously from the groove covering portion of the cover member so as to correspond to a thread insertion opening of the string guiding groove of the pressing portion.

A fourth embodiment of the present invention solves the problems by the bobbin holder according to the first or second embodiment, in which a front-rear deflection restricting portion is provided in the supporting plate portion of the cover member fixed to the supporting portion of the presser foot body, the front-rear deflection restricting portion restricting deflection of the supporting plate portion in a front-rear direction and having a rear restricting plate that is bent toward a rear side of the supporting portion and is positioned so as to be separated from a rear surface of the supporting portion.

In the present invention, the sewing machine presser foot includes: a presser foot body including an attachment portion attached to a presser bar of a sewing machine, a supporting portion extending downward from the attachment portion, and a pressing portion in which, at a lower end of the supporting portion, a needle guiding hole having a string guiding groove for guiding a string is formed; and a cover member including a groove covering portion that crosses and covers the string guiding groove of the pressing portion, a supporting plate portion formed along the supporting portion continuously from the groove covering portion, and an attachment portion formed at an end of the supporting plate portion so as to be attached to the presser foot body, in which a right-side portion of the supporting plate portion of the cover member fixed to the presser foot body by the attachment portion is configured to be displaced from the supporting portion.

Thus, the upper side of the string guiding groove of the pressing portion is covered by the groove covering portion and the groove covering portion can always put the string guiding groove in a closed state by the elastic property of the supporting plate portion. Moreover, a bent portion is provided in the supporting plate portion of the cover member fixed to the presser foot body by the attachment portion, and the right-side portion of the cover member is displaced from the supporting portion.

Due to this, in the process of inserting the decorative string into the needle guiding hole, the groove covering portion is moved from the left side toward the right side by pressing force of the decorative string, and due to the bent portion provided in the supporting plate portion, the right-side region of the supporting plate portion is displaced from the supporting portion of the presser foot body. In this case, the groove covering portion also floats from the pressing portion.

In this case, when the decorative string is inserted into the string guiding groove, the right-side portion of the groove covering portion in relation to the cover member serves as a refuge for overall deformation of the groove covering portion, and the groove covering portion can be easily deformed. Thus, a gap in which the decorative string can be inserted is formed between the string guiding groove and the groove covering portion. In this manner, a state in which the decorative string can be easily moved to the position of the string guiding groove can be created. Therefore, a state in which the decorative string is easily inserted into the needle guiding hole is created, and the inserting operation can be performed easily and quickly.

BRIEF DESCRIPTION OF THE DRAWINGS

FIG. 2A is a front view of the presser foot of the present invention, FIG. 2B is a partial cross-sectional view along arrow Y1 in FIG. 2A, FIG. 2C is a partial cross-sectional view along arrow Y2 in FIG. 2A, FIG. 2D is an enlarged cross-sectional view along arrow X1-X1 in FIG. 2A, and FIG. 2E is an enlarged cross-sectional view along arrow X2-X2 in FIG. 2A;

DESCRIPTION OF THE PREFERRED EMBODIMENTS

Figures 1A, 1B, 1C, 1D:
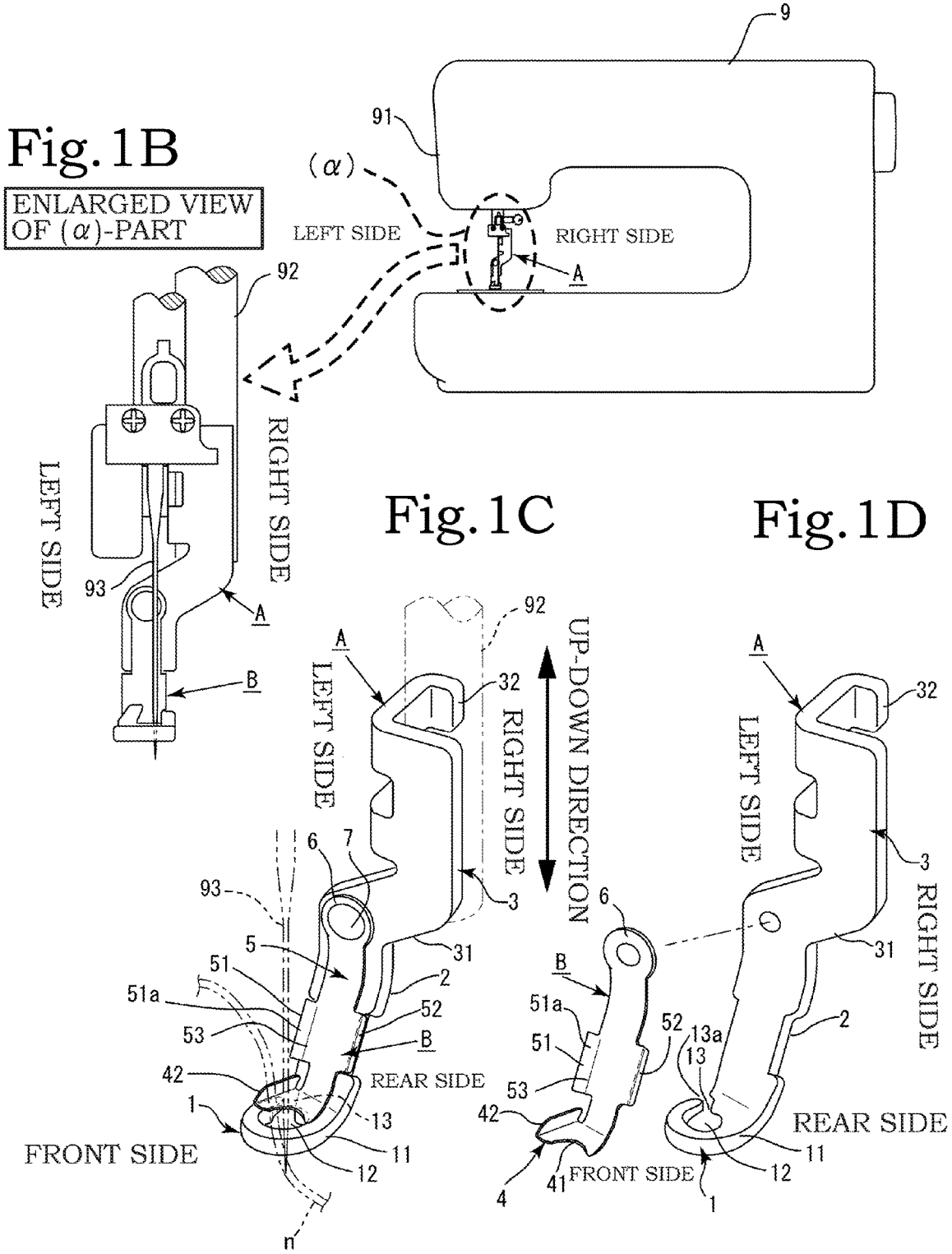
FIG. 1A is a schematic view illustrating a state in which a presser foot of the present invention is attached to a sewing machine.
FIG. 1B is an enlarged view of (a)-part in FIG. 1A.
FIG. 1C is an enlarged perspective view of the presser foot of the present invention.
FIG. 1D is an enlarged perspective view illustrating a presser foot body of the presser foot of the present invention and a cover member in a separated state.

Hereinafter, an embodiment of the present invention will be described with reference to the drawings. The present invention relates to a sewing machine presser foot which is used as a presser foot dedicated for couch stitching, particularly. As illustrated in FIGS. 1A to 1D and FIGS. 2A to 2E, the presser foot of the present invention mainly includes a presser foot body A and a cover member B. In the description of the presser foot of the present invention, the directions such as left and right sides and the up-down direction are defined when an operator sees a sewing machine on the front side. The front and rear sides, the left and right sides, the up-down direction, and the like are described in major drawings. These wordings indicating the directions are described in FIGS. 1A and 1B.

The presser foot body A includes a pressing portion 1, a supporting portion 2, and an attachment portion 3 (see FIGS. 1C and 1D and FIGS. 2A, 2B, and 2C). The pressing portion 1, the supporting portion 2, and the attachment portion 3 are integrally molded by bending a metal plate, for example. The pressing portion 1 includes a pressing plate 11, a needle guiding hole 12, and a string guiding groove 13 connected to the needle guiding hole 12.

The pressing plate 11 is an approximately circular plate and the needle guiding hole 12 is formed substantially at the center of the plate. A sewing machine needle 93 passes through the needle guiding hole 12 (see FIG. 1B). A string guiding groove 13 is formed in a predetermined portion of the needle guiding hole 12, the peripheral portion of the pressing plate 11 and the needle guiding hole 12 communicate with each other through the string guiding groove 13, and a decorative string n is inserted into the needle guiding hole 12 through the string guiding groove 13 from the outside of the pressing portion 1.

The width of the string guiding groove 13 is slightly smaller than the diameter of the needle guiding hole 12 (see FIG. 2E) and has such a size that one decorative string n such as wool yarn can pass through the string guiding groove 13. Moreover, the string guiding groove 13 is formed on a left side surface of the pressing portion 1 as a groove which faces toward the front side from the vicinity of the rear side. The supporting portion 2 is formed continuous with the rear side of the pressing plate 11 so as to extend upward. Further, the supporting portion 2 is formed so as to extend upward from the rear side of the pressing portion 1 in a state of being inclined toward the rear side.

Moreover, the attachment portion 3 is formed so as to extend upward from the upper end of the supporting portion 2. The attachment portion 3 is a portion which plays a role of attaching the presser foot to the presser bar 92. The attachment portion 3 is formed in a vertical form in a state of being shifted to the right side of the supporting portion 2 so as to extend from the upper end of the supporting portion 2 with the interposition of an inclined plate piece 31. Fixing pieces 32 for attaching and fixing the presser foot to the presser bar 92 are formed in an upper portion of the attachment portion 3 (see FIGS. 1C and 1D and FIGS. 2A to 2C).

The cover member B includes a groove covering portion 4, a supporting plate portion 5, a front-rear deflection restricting portion 51, and a width-direction deflection restricting portion 52 (see FIGS. 1C and 1D and FIGS. 2A to 2C). The cover member B is formed by bending an elastic thin metal plate. The groove covering portion 4 has a circular arc-shaped edge 41, the front edge of which has a circular arc shape. When the groove covering portion 4 is disposed on the string guiding groove 13 of the pressing portion 1, this circular arc-shaped edge 41 plays a role of compensating for the missing peripheral portion of the needle guiding hole 12 resulting from the formation of the string guiding groove 13.

Figure 4:
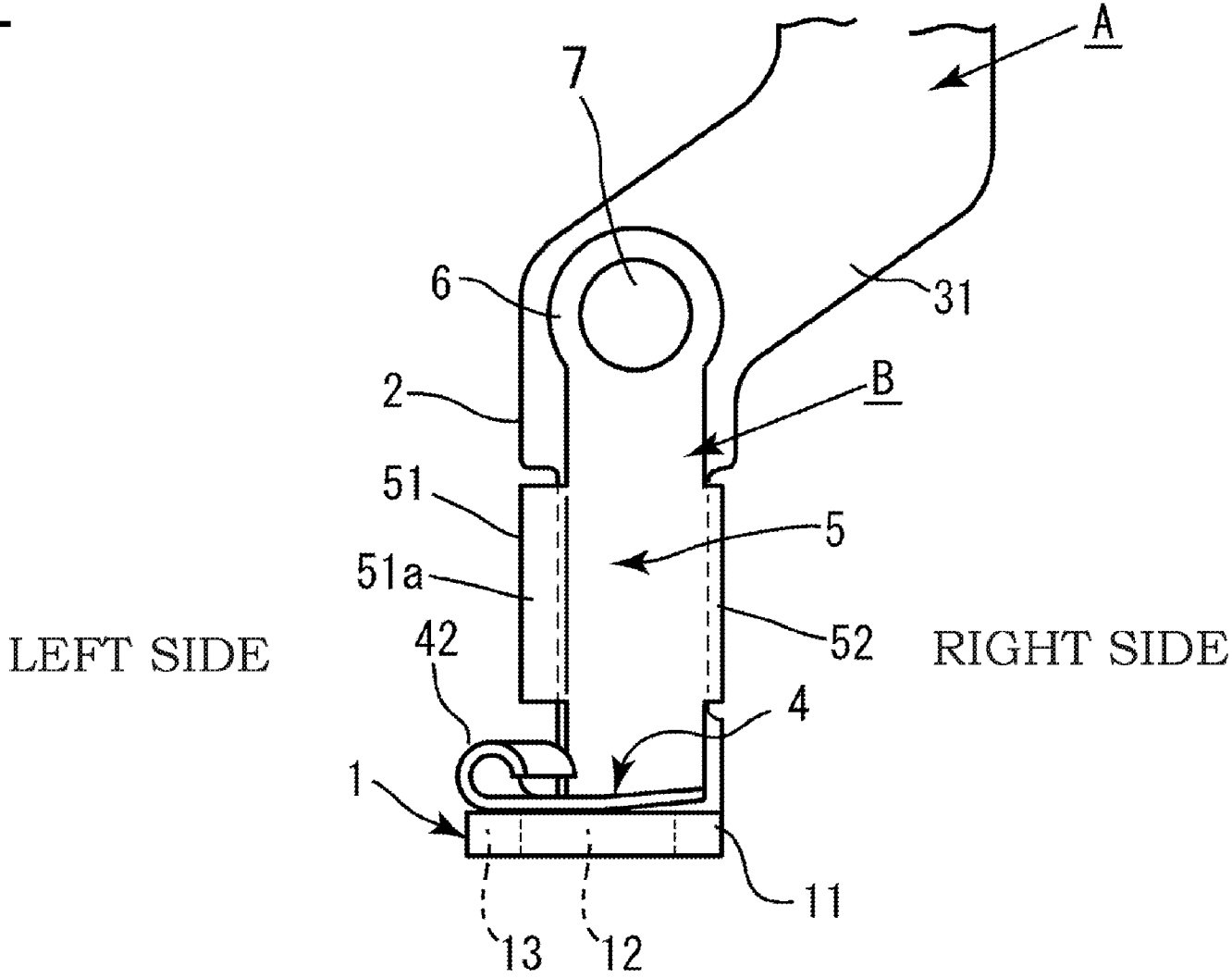
FIG. 4 is an enlarged front view of main parts, illustrating another embodiment of the shape of a string guide of the presser foot of the present invention.
Figure 5A:
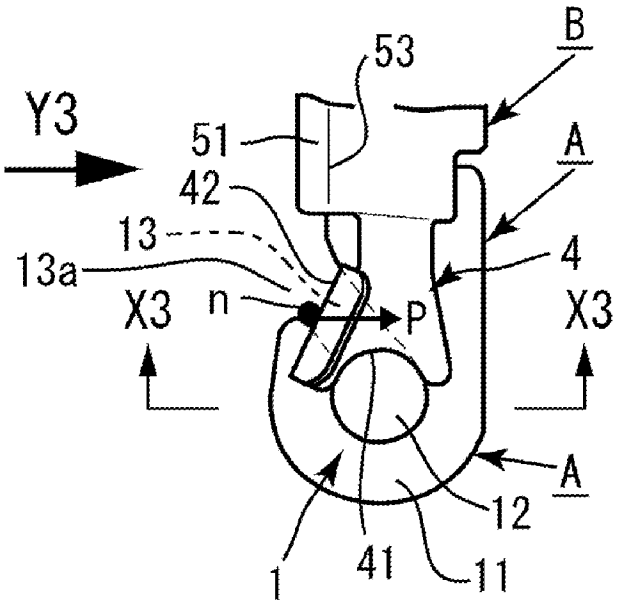
FIG. 5A is a plan view of main parts associated with a first cycle of inserting a decorative string into the presser foot of the present invention.
Figure 5B:
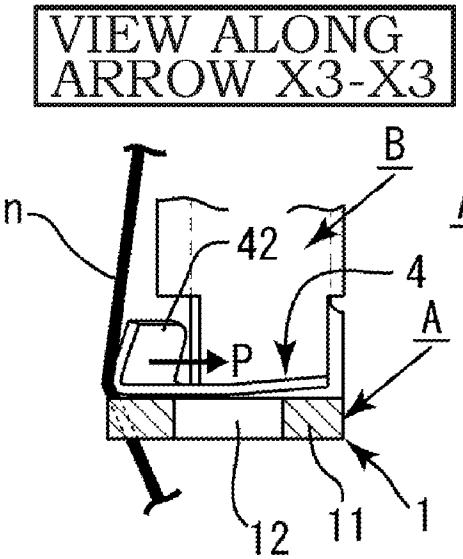
FIG. 5B is a cross-sectional view along arrow X3-X3 in FIG. 5A.
Figure 5C:
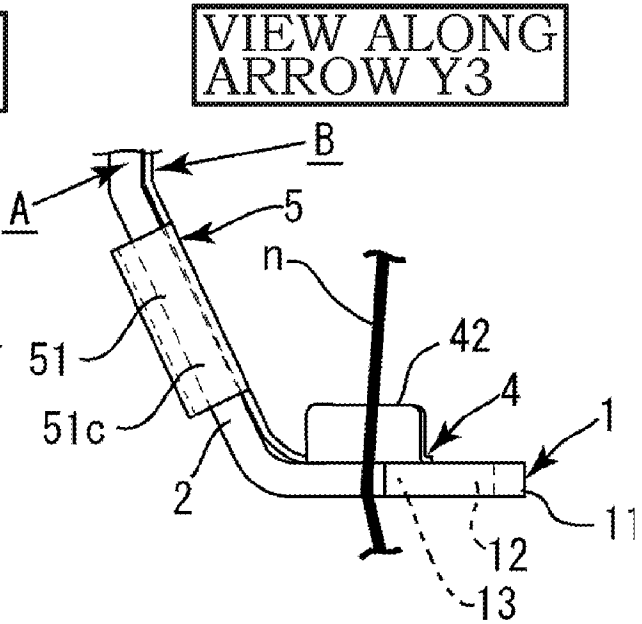
FIG. 5C is a view along arrow Y3 in FIG. 5A.

A string guide 42 which is bent to be erected is formed on the left side surface of the groove covering portion 4. Specifically, the string guide 42 is formed to be erected continuously from the groove covering portion 4 of the cover member B so as to correspond to an insertion opening 13*a* for a thread (the decorative string n), of the string guiding groove 13 of the pressing portion 1 (see FIG. 2E). The string guide 42 is a portion that plays such a role that the decorative string n to be inserted into the needle guiding hole 12 makes contact with the string guide 42 so that the string guide 42 is pressed by pressing force P of the decorative string n and the groove covering portion 4 is moved on the pressing portion 1. The string guide 42 is erected by being bent at an acute angle. Moreover, as another embodiment, the string guide 42 may be formed in an arc form (see FIG. 4).

The supporting plate portion 5 is formed so as to extend further upward than a portion of the groove covering portion 4. Moreover, the front-rear deflection restricting portion 51 and the width-direction deflection restricting portion 52 are formed on the supporting plate portion 5 (see FIGS. 1C and 1D and FIGS. 2A to 2C). An attachment portion 6 is formed in a vertical form to be continuous from the upper end of the supporting plate portion 5.

The attachment portion 6 is fixed to the attachment portion 3 of the presser foot body A by a fixing tool 7 such as a rivet. In a state in which the cover member B is fixed to the presser foot body A, the groove covering portion 4 is arranged on the pressing portion 1 and the supporting plate portion 5 is arranged on the supporting portion 2.

Figure 3:
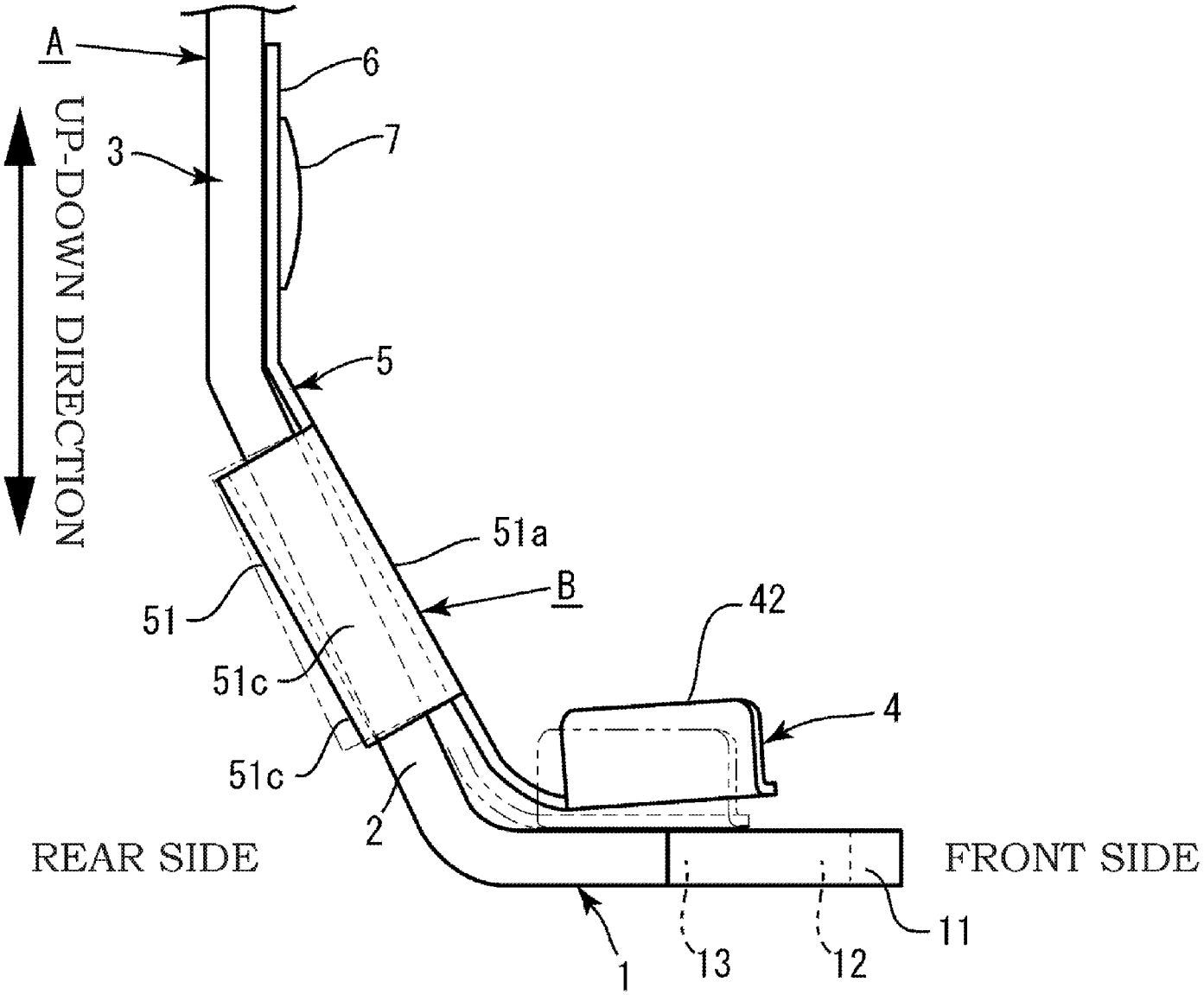
FIG. 3 is an enlarged side view of main parts, illustrating a state in which a supporting plate portion and a groove covering portion of a cover member of the present invention are displaced from a supporting portion and a pressing portion of a body portion.

In a state in which the cover member B is fixed by the fixing tool 7 with an operation of inserting the decorative string n, the supporting plate portion 5 and the groove covering portion 4 float by being displaced from the supporting portion 2 and the pressing portion 1. By the elastic force of the supporting plate portion 5, the groove covering portion 4 is provided so as to always cover the string guiding groove 13 of the pressing portion 1. In this case, the groove covering portion 4 is in a state of making contact with or approaching the pressing portion 1 (see FIG. 3).

The front-rear deflection restricting portion 51 of the supporting plate portion 5 includes a front restricting plate 51*a*, a rear restricting plate 51*b*, and a connecting piece 51*c* that connects both restricting plates (see FIG. 2D). The front-rear deflection restricting portion 51 is formed at the left end of the supporting plate portion 5 and is configured to restrict the movement in the front-rear direction of the supporting portion 2 with allowance with the aid of the front restricting plate 51*a* and the rear restricting plate 51*b* of the front-rear deflection restricting portion 51 (see FIG. 2D). The rear restricting plate 51*b* is normally separated from the rear surface of the supporting plate portion 5 and plays a role of restricting the amount of torsion of the supporting plate portion 5 to fall within a predetermined range when torsion occurs in the supporting plate portion 5 with an operation of inserting the decorative string n.

The interval L between the front restricting plate 51*a* and the rear restricting plate 51*b* is set to be larger than the thickness T of the supporting portion 2.

That is, L>T.

Due to this, the supporting plate portion 5 is configured to be deformable within the range restricted by the front-rear deflection restricting portion 51.

Further, the width-direction deflection restricting portion 52 is formed on the right side of the supporting plate portion 5. The width-direction deflection restricting portion 52 and the front-rear deflection restricting portion 51 sandwich both sides in the width direction of the supporting portion 2. The interval between the width-direction deflection restricting portion 52 and the connecting piece 51*c* of the front-rear deflection restricting portion 51 is larger than the width of the supporting portion 2 and is set to increase on the side where the connecting piece 51*c* is formed (see FIG. 2D).

Due to this, the movement in the left-right direction and the front-rear direction of the cover member B in relation to the presser foot body A is elastically restricted at the position of the fixing tool 7. That is, although the position of the groove covering portion 4 can be moved by elastic deformation of the supporting plate portion 5, the cover member B restricts the magnitude of deformation of the supporting plate portion 5. Due to this, the cover member B can be prevented from being unnecessarily elastically deformed when the decorative string n is inserted into the needle guiding hole 12 of the pressing portion 1, and durability of the cover member B can be secured.

Moreover, a bent portion 53 is formed at a position close to the left side of the supporting plate portion 5 of the cover member B (see FIGS. 1C and 1D and FIGS. 2A and 2D). Specifically, the bent portion 53 is formed as a linear bent line at the boundary of the front restricting plate 51*a* of the supporting plate portion 5.

A right-side region of the supporting plate portion 5 about the bent portion 53 as a boundary is set to float by being displaced from the supporting portion 2 of the presser foot body A (see FIGS. 2C and 2D). Due to this, in an operation of inserting the decorative string n into the needle guiding hole 12, when the groove covering portion 4 is moved from the left side to the right side, the groove covering portion 4 is easily displaced from the string guiding groove 13.

Next, a cycle of inserting the decorative string n into the needle guiding hole 12 of the presser foot of the present invention will be described with reference to FIGS. 5A to 5C and FIGS. 6A to 6C. First, the groove covering portion 4 of the cover member B is disposed so as to cover the string guiding groove 13 of the pressing portion 1 of the presser foot body A. In this state, the decorative string n such as wool yarn is brought into contact with the string guide 42 of the groove covering portion 4. Moreover, the decorative string n is stretched to create pressing force P (see FIGS. 5A to 5C). The decorative string n is bent at the position of the string guide 42 (see FIG. 5B).

Figure 6A:
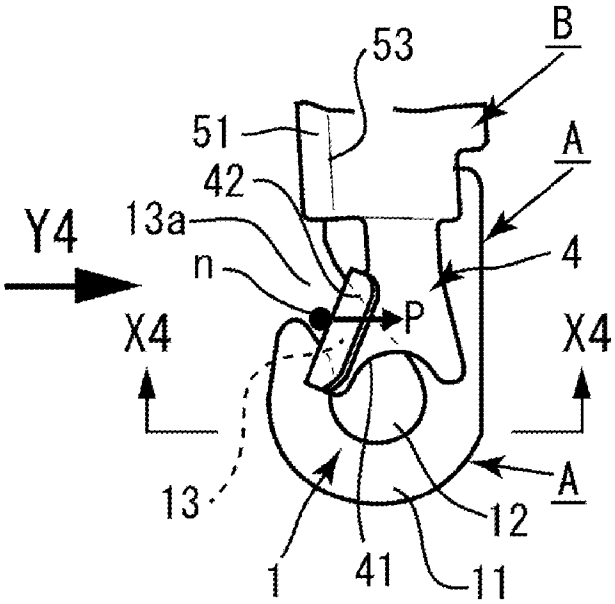
FIG. 6A is a plan view of main parts associated with a second cycle of inserting a decorative string into the presser foot of the present invention.
Figure 6B:
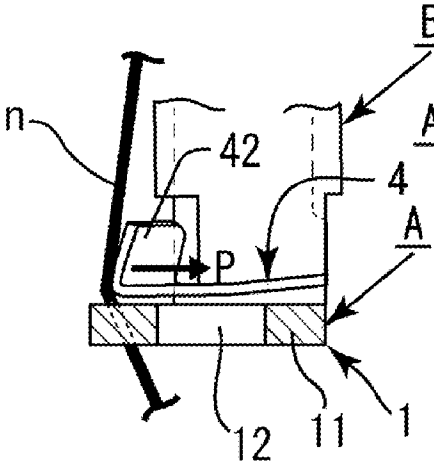
FIG. 6B is a cross-sectional view along arrow X4-X4 in FIG. 6A.
Figure 6C:
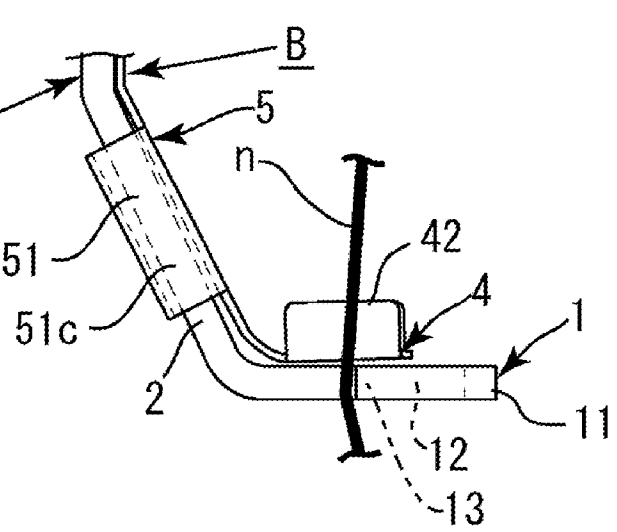
FIG. 6C is a view along arrow Y3 in FIG. 6A.

Subsequently, when the decorative string n having the pressing force P is continuously pressed against the string guide 42, the groove covering portion 4 and the string guide 42 start moving from the left side (the side close to the insertion opening 13*a*) toward the right side (the side close to the needle guiding hole 12) through the string guiding groove 13 of the pressing portion 1 (see FIGS. 6A to 6C). In this case, the decorative string n is bent at the position of the string guide 42, the pressing force P is applied to the groove covering portion 4 to raise the groove covering portion 4 upward. The groove covering portion 4 disposed to cover the string guiding groove 13 of the pressing portion 1 is displaced upward from the string guiding groove 13 (see FIGS. 6B and 6C).

Figure 7A:
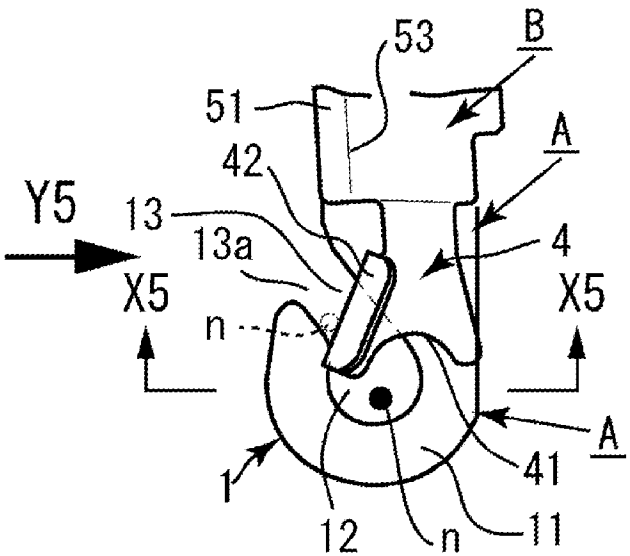
FIG. 7A is a plan view of main parts associated with a third cycle of inserting a decorative string into the presser foot of the present invention.
Figure 7B:
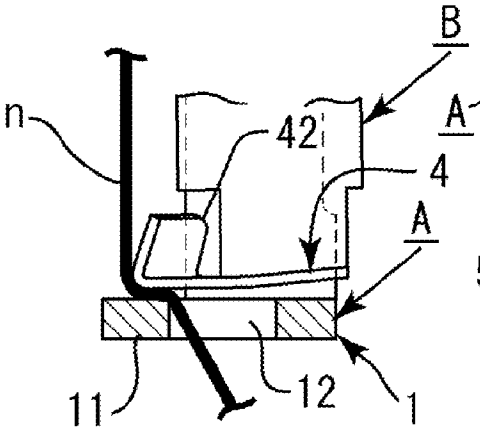
FIG. 7B is a cross-sectional view along arrow X5-X5 in FIG. 7A.
Figure 7C:
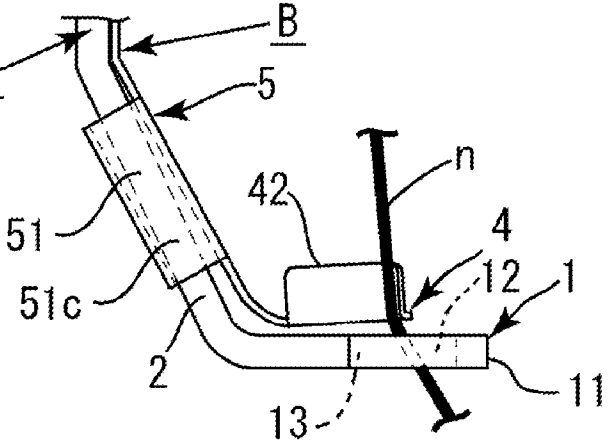
FIG. 7C is a view along arrow Y3 in FIG. 7A.

Subsequently, when the decorative string n is further moved from the left side of the pressing portion 1 toward the right side, the groove covering portion 4 moves while being displaced further from the string guiding groove 13 and the decorative string n reaches the needle guiding hole 12 from the string guiding groove 13 (see FIGS. 7A to 7C). When the decorative string n is completely inserted into the needle guiding hole 12, the decorative string n detaches from the string guide 42 and the groove covering portion 4 approaches the string guiding groove 13 to close the string guiding groove 13. In this way, the decorative string n is prevented from detaching from the needle guiding hole 12.

Here, in the process of inserting the decorative string n into the needle guiding hole 12, the groove covering portion 4 is moved from the left side toward the right side by the pressing force P of the decorative string n, and the right-side region of the supporting plate portion 5 is displaced from the supporting portion 2 of the presser foot body A by the bent portion 53 formed in the supporting plate portion 5. In this case, the groove covering portion 4 also floats from the pressing portion 1.

In this way, when the decorative string n is inserted into the string guiding groove 13, the right-side portion of the groove covering portion 4 in relation to the cover member B serves as a refuge for overall deformation of the groove covering portion 4, and the groove covering portion 4 can be easily deformed. Thus, a gap in which the decorative string n can be inserted is formed between the string guiding groove 13 and the groove covering portion 4. In this manner, a state in which the decorative string n can be easily moved to the position of the string guiding groove 13 can be created.

In the second embodiment, since the bent portion is formed at a position near the left end in the left-right direction of the supporting plate portion of the cover member, substantially the entire portion of the supporting plate portion except the left end in the left-right direction floats by being displaced elastically from the supporting portion of the presser foot body. Due to this, the groove covering portion can be more easily displaced in relation to the upper side of the string guiding groove of the pressing portion and the operation of inserting the decorative string can be performed more easily and quickly.

In the third embodiment, since the string guide is formed at the left end of the groove covering portion of the cover member, in the process of inserting the decorative string into the needle guiding hole, the decorative string makes substantially surface-contact with the string guide. Thus, it is possible to protect the decorative string so that intensive load is not applied to the decorative string especially during the insertion operation.

In the fourth embodiment, the restricting portion which includes the front restricting plate and the rear restricting plate and has a C-shaped cross-sectional shape is formed on the left side in the width direction of the supporting plate portion of the cover member, and the interval between the front restricting plate and the rear restricting plate is larger than the thickness of the supporting portion. Thus, it is possible to restrict a separation distance of the cover member from the supporting portion of the presser foot body, restrict a separation distance of the groove covering portion from the upper surface of the string guiding groove, and prevent deformation resulting from too much displacement.

What is claimed is:

1. A sewing machine presser foot, comprising:

a presser foot body including an attachment portion attached to a presser bar of a sewing machine, a supporting portion extending downward from the attachment portion, and a pressing portion in which, at a lower end of the supporting portion, a needle guiding hole including a string guiding groove for guiding a string is formed; and a cover member including a groove covering portion that crosses and covers the string guiding groove of the pressing portion, a supporting plate portion formed along the supporting portion continuously from the groove covering portion, and another attachment portion formed at an end of the supporting plate portion so as to be attached to the supporting portion of the presser foot body, wherein a right-side portion of the supporting plate portion of the cover member fixed to the presser foot body by the attachment portion is configured to be displaced from the supporting portion.

2. The sewing machine presser foot according to claim 1, wherein a bent portion provided in the supporting plate portion is formed to be bent in such a direction that the supporting plate portion is displaced from the supporting portion in a left-right direction of the supporting plate portion of the cover member.

3. The sewing machine presser foot according to claim 1, wherein a string guide is formed to be erected continuously from the groove covering portion of the cover member so as to correspond to a thread insertion opening of the string guiding groove of the pressing portion.

4. The sewing machine presser foot according to claim 1, wherein a front-rear deflection restricting portion is provided in the supporting plate portion of the cover member fixed to the supporting portion of the presser foot body, the front-rear deflection restricting portion restricting deflection of the supporting plate portion in a front-rear direction and including a rear restricting plate that is bent toward a rear side of the supporting portion and is positioned so as to be separated from a rear surface of the supporting portion.

5. The sewing machine presser foot according to claim 1, wherein the supporting portion and the attachment portion are integrally formed by bending a metal plate.

6. The sewing machine presser foot according to claim 1, wherein the supporting portion and the attachment portion are integral parts of a single metal plate.

7. The sewing machine presser foot according to claim 1, wherein an entirety of the presser foot body is a single plate that includes the supporting portion and the attachment portion.

8. The sewing machine presser foot according to claim I, wherein the attachment portion of the presser foot body abuts said another attachment portion of the cover member.

9. The sewing machine presser foot according to claim 1, wherein a surface of the attachment portion of the presser foot body contacts a surface of said another attachment portion of the cover member.

10. The sewing machine presser foot according to claim 1, wherein, in a side view, the supporting portion continuously extends downward from the attachment portion.

11. The sewing machine presser foot according to claim 1, wherein, in a side view, a surface of the supporting portion is flush with a surface of the attachment portion.

12. The sewing machine presser foot according to claim 1, wherein a front-rear deflection restricting portion is provided in the supporting plate portion of the cover member fixed to the supporting portion of the presser foot body.

13. The sewing machine presser foot according to claim 12, wherein the front-rear deflection restricting portion restricts deflection of the supporting plate portion in a front-rear direction.

14. The sewing machine presser foot according to claim 12, wherein the front-rear deflection restricting portion includes a rear restricting plate that is bent toward a rear side of the supporting portion.

15. The sewing machine presser foot according to claim 12, wherein the front-rear deflection restricting portion includes a rear restricting plate that is positioned to be separated from a rear surface of the supporting portion.

16. A sewing machine presser foot, comprising:

a presser foot body including an attachment portion attached to a presser bar of a sewing machine, a supporting portion extending downward from the attachment portion, and a pressing portion in which, at a lower end of the supporting portion, a needle guiding hole including a string guiding groove for guiding a string is formed; and a cover member including a groove covering portion that crosses and covers the string guiding groove of the pressing portion, a supporting plate portion formed along the supporting portion continuously from the groove covering portion, and another attachment portion formed at an end of the supporting plate portion so as to be attached to the presser foot body, wherein a right-side portion of the supporting plate portion of the cover member fixed to the presser foot body by the attachment portion is configured to be displaced from the supporting portion, and wherein a front-rear deflection restricting portion is provided in the supporting plate portion of the cover member fixed to the supporting portion of the presser foot body; the front-rear deflection restricting portion restricting deflection of the supporting plate portion in a front-rear direction and including a rear restricting plate that is bent toward a rear side of the supporting portion and is positioned so as to be separated from a rear surface of the supporting portion.

* * * * *